US008985568B2

(12) United States Patent
Ito

(10) Patent No.: US 8,985,568 B2
(45) Date of Patent: Mar. 24, 2015

(54) PAPER DISCHARGE DEVICE OF IMAGE FORMING APPARATUS

(71) Applicants: Kabushiki Kaisha Toshiba, Tokyo (JP); Toshiba Tec Kabushiki Kaisha, Tokyo (JP)

(72) Inventor: Shinichi Ito, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/156,999

(22) Filed: Jan. 16, 2014

(65) Prior Publication Data

US 2014/0151956 A1 Jun. 5, 2014

Related U.S. Application Data

(63) Continuation of application No. 13/222,849, filed on Aug. 31, 2011, now Pat. No. 8,662,498.

(60) Provisional application No. 61/406,991, filed on Oct. 26, 2010.

(51) Int. Cl.

| | |
|---|---|
| ***B65H 1/00*** | (2006.01) |
| ***B65H 5/22*** | (2006.01) |
| ***B65H 31/04*** | (2006.01) |
| ***B65H 31/00*** | (2006.01) |
| ***B65H 31/02*** | (2006.01) |
| ***B65H 29/22*** | (2006.01) |
| ***B65H 29/58*** | (2006.01) |

(52) U.S. Cl.

CPC ..... *B65H 31/00* (2013.01); *B65H 31/02* (2013.01); *B65H 29/22* (2013.01); *B65H 29/58* (2013.01); *B65H 2405/324* (2013.01); *B65H 2801/06* (2013.01)

USPC ..... 271/3.01; 271/163; 271/213

(58) Field of Classification Search

CPC ..... B65H 1/00; B65H 31/00; B65H 31/22; B65H 83/00; B65H 99/00; B65H 85/00; B65H 2405/10; B65H 2407/21; B65H 2801/03; B65H 2801/06

USPC ..... 271/3.01, 3.14, 163, 65, 186, 902, 298, 271/303, 213

See application file for complete search history.

(56) References Cited

U.S. PATENT DOCUMENTS

| | | | |
|---|---|---|---|
| 6,015,147 | A | 1/2000 | Kimura et al. |
| 6,215,970 | B1 | 4/2001 | Yoshikawa et al. |
| 6,595,514 | B2 | 7/2003 | Takahashi |
| 6,848,685 | B2 | 2/2005 | Katsuyama |
| 6,945,720 | B2 * | 9/2005 | Maekawa et al. ..... 400/624 |

(Continued)

FOREIGN PATENT DOCUMENTS

| | | |
|---|---|---|
| JP | 2001-240314 | 9/2001 |

OTHER PUBLICATIONS

Office Action dated Jan. 24, 2014, filed in corresponding Chinese Patent Application No. 201110321889.X.

*Primary Examiner* — David H Bollinger

(74) *Attorney, Agent, or Firm* — Patterson & Sheridan LLP

(57) ABSTRACT

According to one embodiment, a paper discharge device includes a discharged-sheet receiving part that can be opened and closed on a side surface of an apparatus body, is closed on the side surface and receives a recording medium dropped from above along the side surface after image formation.

9 Claims, 4 Drawing Sheets

(56) References Cited

U.S. PATENT DOCUMENTS

| | | | | |
|---|---|---|---|---|
| 7,079,806 | B2 | 7/2006 | Baek et al. | |
| 7,984,909 | B2 * | 7/2011 | Sunohara | 271/301 |
| 8,371,582 | B2 * | 2/2013 | Matsuno et al. | 271/302 |
| 8,662,498 | B2 * | 3/2014 | Ito | 271/163 |
| 2008/0284090 | A1 | 11/2008 | Honda et al. | |
| 2008/0296834 | A1 | 12/2008 | Matsubara et al. | |
| 2009/0047051 | A1 | 2/2009 | Suzaki | |
| 2009/0309296 | A1 | 12/2009 | Taki et al. | |

* cited by examiner

PAPER DISCHARGE DEVICE OF IMAGE FORMING APPARATUS

CROSS-REFERENCE TO RELATED APPLICATION

This application is based upon and claims the benefit of priority from U.S. application Ser. No. 13/222,849, filed on Aug. 31, 2011, which claims the benefit of priority from Provisional U.S. Application 61/406,991, filed on Oct. 26, 2010, the entire contents of which are incorporated herein by reference.

FIELD

Embodiments described herein relate generally to a space-saving paper discharge device to discharge a sheet after image formation in an image forming apparatus such as a copying machine or a printer.

BACKGROUND

In an image forming apparatus such as a copying machine or a printer, there is an apparatus in which a dual purpose tray having both a manual feed function and a paper discharge function is pulled out from a side surface of an apparatus body, and manual feed of a sheet or discharge of a sheet is performed.

However, if the dual purpose tray is used as an auxiliary tray for performing the paper discharge function, the dual purpose tray must be protruded from the apparatus body to the outside.

Thus, a paper discharge device capable of supporting a sheet discharged from an apparatus body even in a state where a dual purpose tray is folded on a side surface of the apparatus body is desired to be developed.

DETAILED DESCRIPTION

In general, according to one embodiment, a paper discharge device includes a discharged-sheet receiving part that can be opened and closed on a side surface of an apparatus body, is closed on the side surface and receives a recording medium dropped from above along the side surface after image formation.

Figure 1:
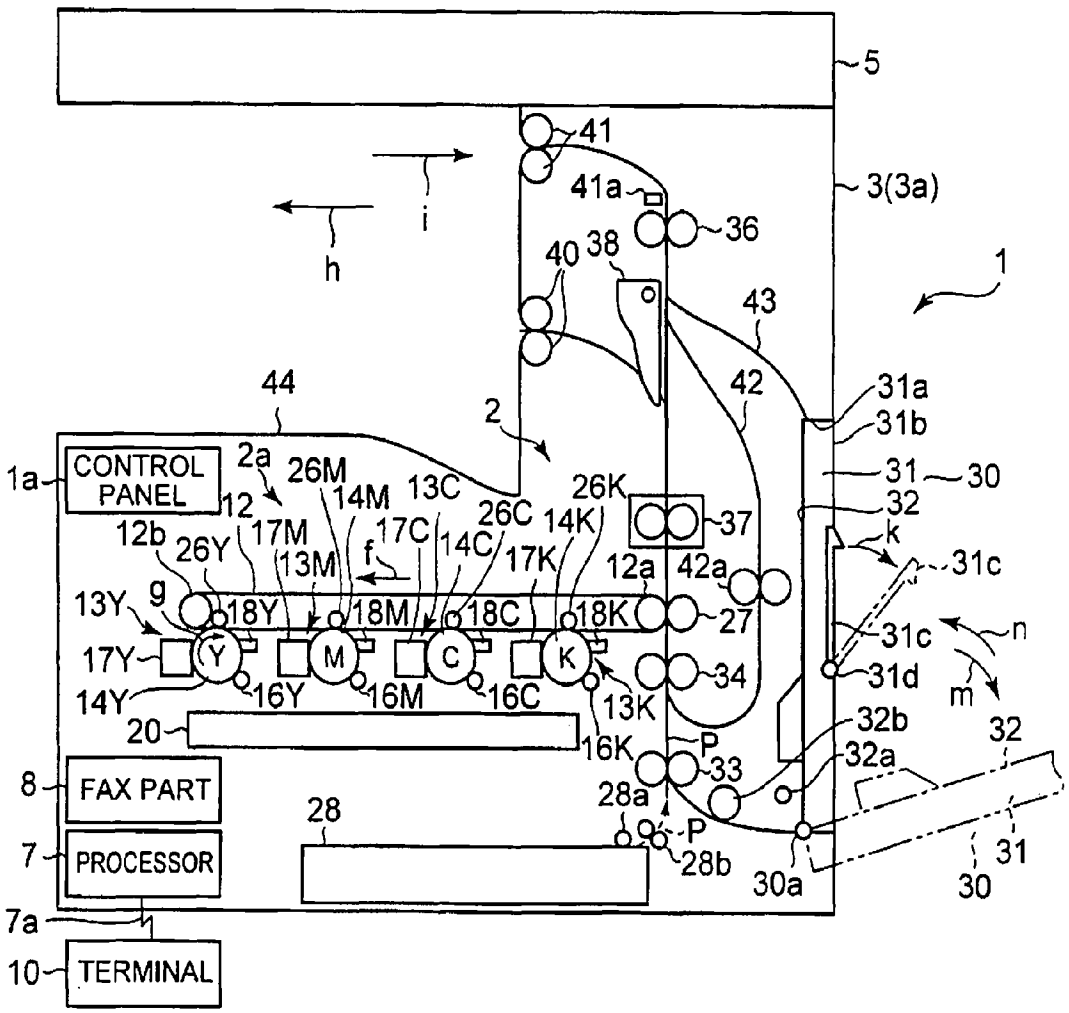
FIG. 1 is a schematic structural view showing an image forming apparatus of an embodiment.

Hereinafter, an embodiment will be described. FIG. 1 shows an image forming apparatus 1 of the embodiment. The image forming apparatus 1 includes a printer 2 and a scanner 5. Further, the image forming apparatus 1 includes a control panel la, a processor 7 and a FAX part 8. The control panel la is used for display of information or input of an operation. The processor 7 executes an image forming process or an image reading process of an image forming job or the like transmitted from a terminal 10 connected through a network line 7*a*. The FAX part 8 transmits and receives a facsimile signal.

The printer 2 includes four sets of image forming stations 13Y, 13M, 13C and 13K along a lower side of a transfer belt 12. A backup roller 12*a* and a driven roller 12*b* support the transfer belt 12, and move the transfer belt 12 in an arrow f direction. The respective image forming stations 13Y, 13M, 13C and 13K form toner images of Y (Yellow), M (Magenta), C (Cyan) and K (black) on respective photoconductive drums 14Y, 14M, 14C and 14K. Incidentally, the printer 2 may include only, for example, the K (black) image forming station 13K to support monochrome printing.

The respective image forming stations 13Y, 13M, 13C and 13K include chargers 16Y, 16M, 16C and 16K, developing devices 17Y, 17M, 17C and 17K and photoreceptor cleaners 18Y, 18M, 18C and 18K around the respective photoconductive drums 14Y, 14M, 14C and 14K rotating in an arrow g direction.

The printer 2 includes a laser exposure device 20 constituting an image forming part 2*a*. The laser exposure device 20 irradiates laser lights corresponding to the respective colors to the respective photoconductive drums 14Y, 14M, 14C and 14K between the chargers 16Y, 16M, 16C and 16K and the developing devices 17Y, 17M, 17C and 17K, and form electrostatic latent images on the photoconductive drums 14Y, 14M, 14C and 14K. The developing devices 17Y, 17M, 17C and 17K develop the electrostatic latent images formed on the respective photoconductive drums 14Y, 14M, 14C and 14K, and forms toner images of yellow (Y), magenta (M), cyan (C) and black (K) on the photoconductive drums 14Y, 14M, 14C and 14K.

The printer 2 includes primary transfer rollers 26Y, 26M, 26C and 26K at positions facing the photoconductive drums 14Y, 14M, 14C and 14K through the transfer belt 12. The primary transfer rollers 26Y, 26M, 26C and 26K multiple-transfer the toner images on the photoconductive drums 14Y, 14M, 14C and 14K onto the transfer belt 12. The photoreceptor cleaners 18Y, 18M, 18C and 18K remove and collect toners remaining on the photoconductive drums 14Y, 14M, 14C and 14K after a primary transfer.

The printer 2 includes a secondary transfer roller 27 at a secondary transfer position facing the backup roller 12*a* through the transfer belt 12. The printer 2 includes a paper feed cassette 28 to supply a sheet P as a recording medium toward the secondary transfer roller 27. The printer 2 includes a paper discharge device 30 used also as a manual paper feed part on a side surface 3*a* of a housing 3 as an apparatus body.

The paper discharge device 30 is opened and closed at the side surface of the housing 3 around a shaft 30*a*. The paper discharge device 30 includes a receiving tray 31 as a discharged-sheet receiving part and a manual feed tray 32 as a manual paper feed part. The paper discharge device 30 includes, at an end of the receiving tray 31, a drop port 31*a* to introduce the sheet P dropped from above and discharged if the paper discharge device 30 closes the side surface 3*a* of the housing 3 as indicated by a solid line of FIG. 1. As indicated by a dotted line of FIG. 1, if the paper discharge device 30 opens the side surface 3*a* of the housing 3, the paper discharge device supplies the sheet on the manual feed tray 32 toward the secondary transfer roller 27.

A pickup roller 28*a*, a separation roller 28*b*, a conveyance roller 33 and a register roller pair 34 are positioned between the paper feed cassette 28 and the secondary transfer roller 27. A manual feed pickup roller 32*a* and a manual feed separation roller 32*b* are positioned between the manual feed tray 32 and the conveyance roller 33.

After aligning a leading edge of the sheet P taken out from the paper feed cassette 28 or the sheet P supplied from the manual feed tray 32, the register roller pair 34 conveys the sheet to the secondary transfer roller 27. The printer 2 secondarily transfers the toner images on the transfer belt 12 onto the sheet P conveyed from the register roller pair 34 at a nip between the transfer belt 12 and the secondary transfer roller 27 in a lump, and forms a non-fixed toner image on the sheet P. The printer 2 includes a fixing device 37 at the downstream side of the secondary transfer roller 27 along the conveyance direction of the sheet P. The fixing device 37 fixes the toner image to the sheet P.

The transfer belt 12, the image forming stations 13Y, 13M, 13C and 13K, the primary transfer rollers 26Y, 26M, 26C and 26K, the secondary transfer roller 27, and the fixing device 37 constitute the image forming part 2*a*.

The printer 2 includes a gate 38 at the downstream side of the fixing device 37. The gate 38 distributes the sheet P conveyed from the fixing device 37 toward a paper discharge roller 40 or a switch-back roller 41. The gate 38 distributes the sheet P conveyed from the switch-back roller 41 toward a re-conveyance path 42 or the paper discharge device 30.

Figure 2:
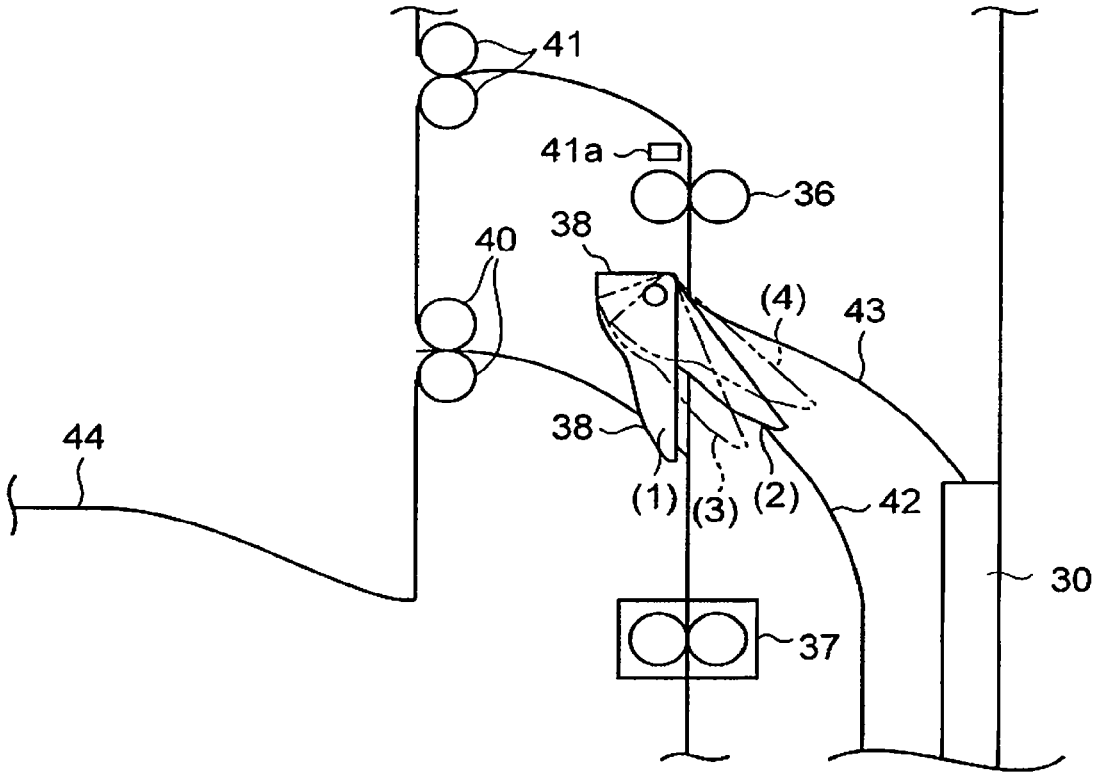
FIG. 2 is a schematic explanatory view showing a gate of the image forming apparatus of the embodiment.

As shown in FIG. 2, the gate 38 switches among a first position (1), a second position (2), a third position (3) and a fourth position (4). If the gate 38 is at the first position (1), the gate distributes the sheet P conveyed from the fixing device 37 toward the switch-back roller 41. The switch-back roller 41 once conveys the sheet P conveyed from the gate 38 in an arrow h direction. If a sheet detection switch 41*a* detects that a trailing edge of the sheet P passes an auxiliary conveyance roller 36, the switch-back roller 41 reversely rotates and conveys the sheet P in an arrow i direction.

If the gate 38 is at the second position (2), the gate distributes the sheet P conveyed from the fixing device 37 toward the paper discharge roller 40. The paper discharge roller 40 discharges the sheet P to a main tray 44 which is a main paper discharge part and is in a hollow body of the image forming apparatus 1.

If the gate 38 is at the third position (3), the gate distributes the sheet P conveyed from the switch-back roller 41 toward the re-conveyance path 42. The sheet P is again conveyed toward the register roller pair 34 by a re-conveyance roller 42*a*. If the gate 38 is at the fourth position (4), the gate distributes the sheet P conveyed from the switch-back roller 41 toward the paper discharge device 30. The sheet P drops into the receiving tray 31 of the paper discharge device 30 and is received.

The paper discharge device 30 will be described in detail. As indicated by the solid line of FIG. 1, if the paper discharge device 30 is closed on the side surface 3*a* of the housing 3, a side surface 31*b* of the receiving tray 31 is on the same plane as the side surface 3*a* of the housing 3. Further, the receiving tray 31 includes an opening and closing cover 31*c* to take out a sheet in the receiving tray 31 at the side surface 31*b*. The opening and closing cover 31*c* opens in an arrow k direction around a shaft 31*d*.

Incidentally, the paper discharge device 30 may include an opening and closing cover at the front side so that the sheet in the receiving tray 31 is taken out from the front side of the image forming apparatus 1. Alternatively, the front side of the receiving tray 31 may be open. The paper discharge device 30 is formed of, for example, a highly translucent material, and the user can easily visually confirm whether or not the sheet P is discharged into the receiving tray 31.

If printing starts, the user opens or closes the paper discharge device 30 in accordance with a paper feed mode. Alternatively, the printer 2 switches the gate 38 to one of the first position (1) to the fourth position (4) in accordance with a print mode.

[Manual Paper Feed Mode]

If the paper feed mode is a manual paper feed mode, the user rotates the paper discharge device 30 in an arrow m direction, and opens the manual feed pickup roller 32*a* and the manual feed separation roller 32*b*. The user places the sheet P on the manual feed tray 32, sets a document on the scanner 5, sets the print mode through the control panel 1*a* and starts printing.

Figure 3:
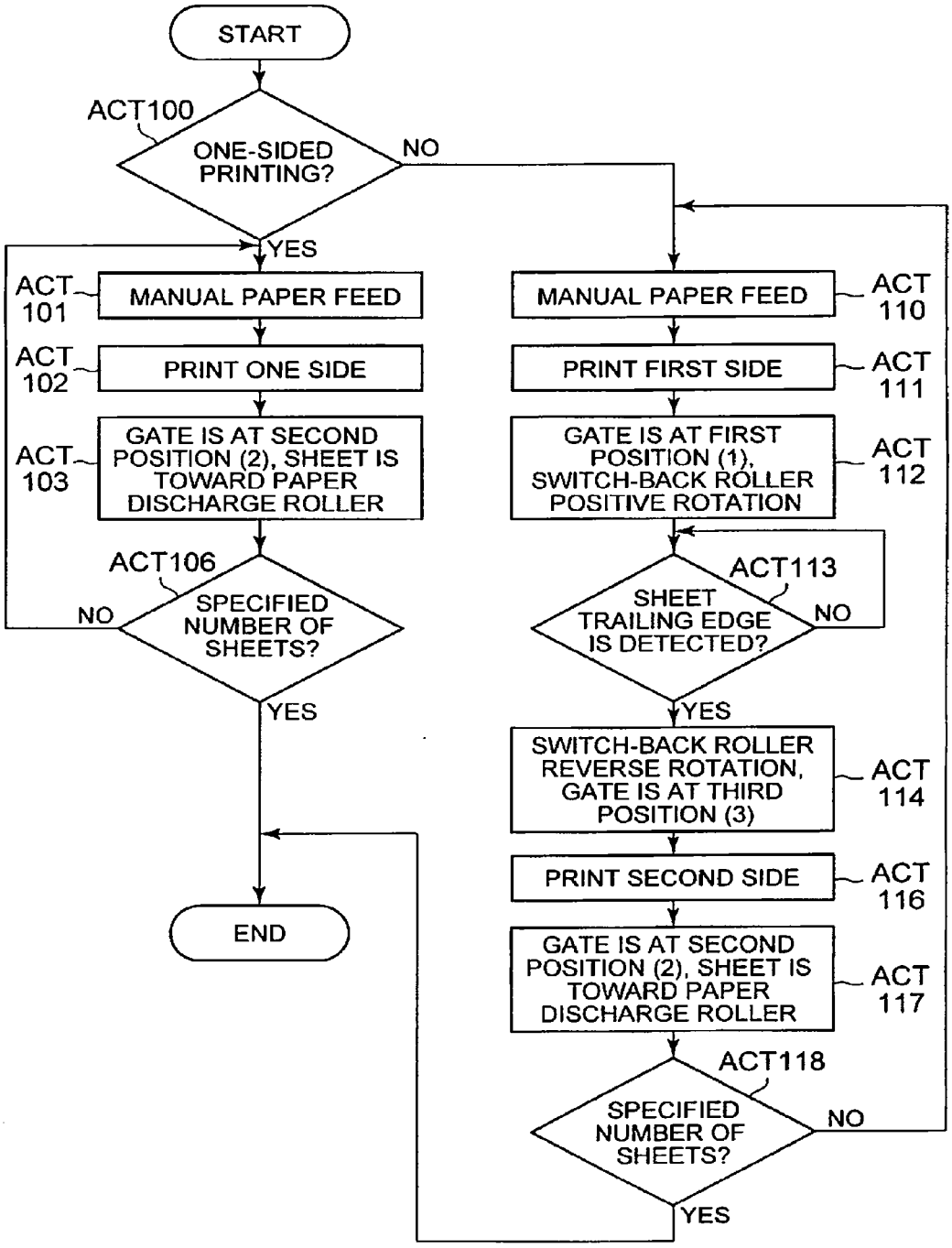
FIG. 3 is a flowchart showing a print operation in a manual paper feed mode of the image forming apparatus of the embodiment.

FIG. 3 shows a flowchart of a print operation in the manual paper feed mode. At ACT 100, if a mode is a one-sided printing mode, at ACT 101, manual paper feeding is performed, and at ACT 102, the printer 2 prints one side of the sheet P. At ACT 103, the sheet P is distributed toward the paper discharge roller 40 by the gate 38 located at the second position (2) and is discharged to the main tray 44. At ACT 106, one-sided printing is repeated until a specified number of sheets are printed, and if the specified numbers of sheets are printed, the printing is ended.

At ACT 100, if a mode is a two-sided printing mode, at ACT 110, manual paper feeding is performed, and at ACT 111, the printer 2 prints the first side of the sheet P. At ACT 112, the sheet P is distributed toward the switch-back roller 41 by the gate 38 located at the first position (1). The switch-back roller 41 is positively rotated and conveys the sheet P in the arrow h direction.

At ACT 113, if the sheet detection switch 41*a* detects that the trailing edge of the sheet P passes the auxiliary conveyance roller 36, at ACT 114, the switch-back roller 41 is reversely rotated, and the gate 38 is set to the third position (3). The switch-back roller 41 conveys the sheet P in the arrow i direction, and the sheet P is distributed toward the re-conveyance path 42.

At ACT 116, the printer 2 prints the second side of the sheet P. At ACT 117, the sheet P is distributed toward the paper discharge roller 40 by the gate 38 located at the second position (2) and is discharged to the main tray 44. At ACT 118, two-sided printing is repeated until a specified number of sheets are printed, and if the specified numbers of sheets are printed, the printing is ended.

[Auto Feed Mode]

If a paper feed mode is an auto feed mode from the cassette 28, the user rotates the paper discharge device 30 in an arrow n direction, and closes the side surface 3*a* of the housing 3. For example, if the printing is such that a document image is read from the scanner 5, the user sets the document on the scanner 5, sets the print mode through the control panel 1*a*, and starts printing.

If the printing is such that the document image is read from the scanner 5, the print operation in the auto feed mode is the same as that of the manual paper feed mode except that paper feeding at ACT 101 or ACT 110 in the flowchart of the manual paper feed shown in FIG. 3 is performed from the paper feed cassette 28.

Next, if the print mode is such that printing is performed based on, for example, a reception signal from the FAX part 8, the processor 7 sets the gate 38 so that the print image is discharged to the receiving tray 31 of the paper discharge device 30.

Figure 4:
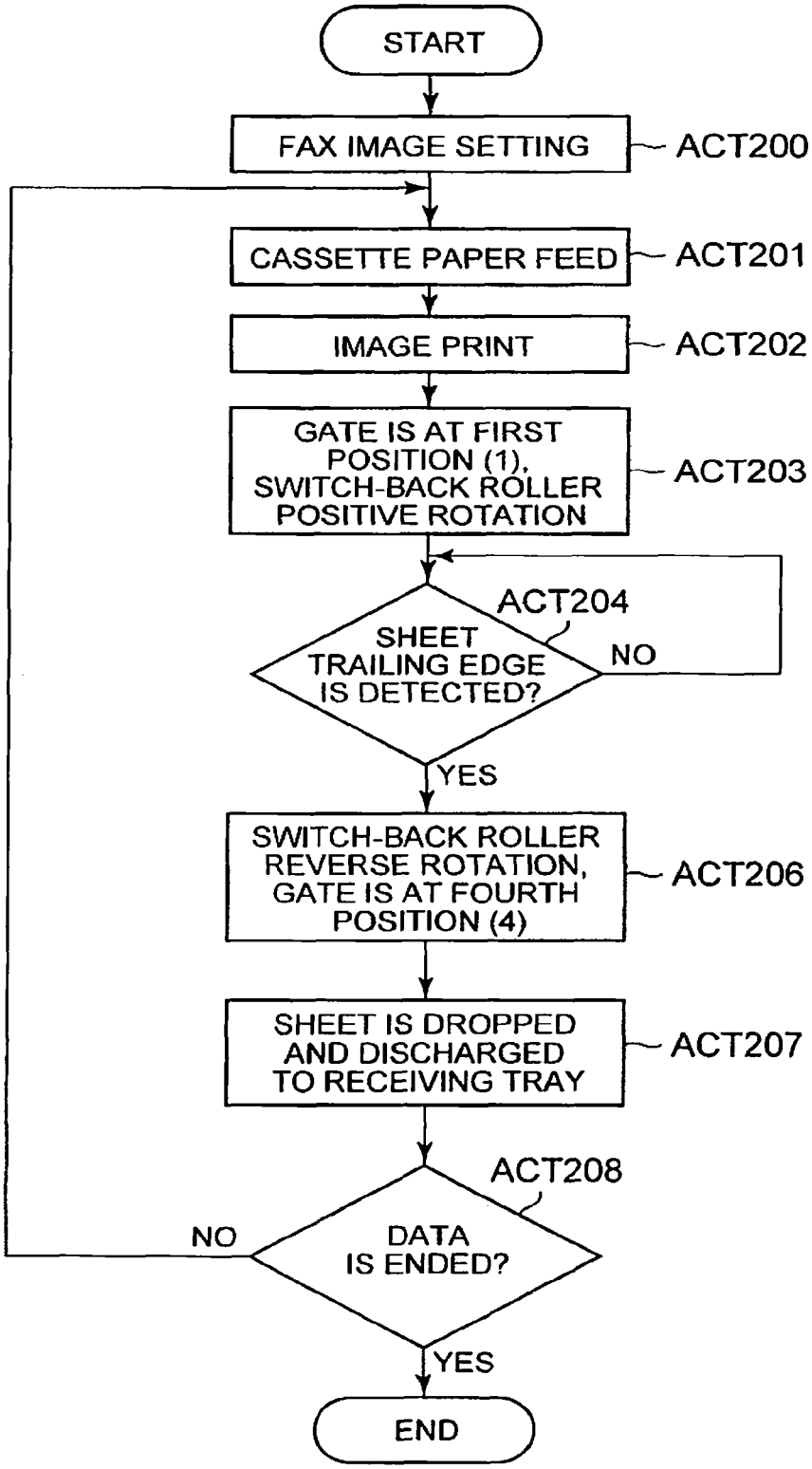
FIG. 4 is a flowchart showing a print operation of a FAX image in an auto feed mode in the image forming apparatus of the embodiment.

FIG. 4 shows a flowchart of a print operation of a FAX image. At ACT 200, printing of the FAX image is set, and at ACT 201, paper feeding from the paper feed cassette 28 is performed. At ACT 202, an image based on reception data from the FAX part 8 is printed on the sheet P. At ACT 203, the gate 38 located at the first position (1) distributes the sheet P toward the switch-back roller 41. The switch-back roller 41 is positively rotated and conveys the sheet P in the arrow h direction.

At ACT 204, if the sheet detection switch 41*a* detects that the trailing edge of the sheet P passes the auxiliary conveyance roller 36, at ACT 206, the switch-back roller 41 is reversely rotated, and the gate 38 is set to the fourth position (4). The switch-back roller 41 conveys the sheet P in the arrow i direction, and the sheet P is distributed toward the paper discharge device 30. At ACT 207, the sheet P drops into the receiving tray 31 through the drop port 31*a* of the receiving tray 31 and is discharged. At ACT 208, printing of the FAX image is repeated until the reception data from the FAX part 8 is ended, and if a specified number of sheets are printed, the printing is ended.

The user visually confirms whether the sheet P is discharged to the receiving tray 31 of the paper discharge device 30. If the sheet P is discharged to the receiving tray 31, as indicated by the dotted line in FIG. 1, the user opens the opening and closing cover 31*c* in the arrow k direction, and takes out the sheet P in the receiving tray 31. Even if the sheet P is taken out from the side surface 3*a* of the housing 3, the opening and closing cover 31*c* has only to be opened, and the space used for the operation of taking out the sheet P can be made compact. Incidentally, if the opening and closing cover is provided at the front side of the receiving tray 31 or the front side surface is open, the sheet P is taken out from the front side.

Incidentally, with respect to the paper discharge to the receiving tray 31, not the FAX image, but an image printed after reading a document image by the scanner 5 may be adopted, or an image based on data sent from the terminal 10 through the network line 7*a* may be adopted.

According to the embodiment, the paper discharge device 30 including the receiving tray 31 in which the sheet P is dropped and is received, and the manual feed tray 32 is arranged to be openable and closable on the side surface 3*a* of the housing 3. If the paper discharge device 30 is closed with respect to the side surface 3*a* and is housed in the housing 3, the paper discharge device can receive the sheet P discharged after printing in the receiving tray 31. If manual paper feeding is performed, the user opens the paper discharge device 30 from the side surface 3*a*, and uses the manual feed tray 32. The receiving tray 31 is not required to be always arranged in the state of protruding from the side surface 3*a* of the housing 3. The space for the receiving tray 31 is not required at the outside of the housing 3.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. An image forming apparatus comprising:

an image forming part configured to form an image on a recording medium; and a discharged-sheet receiving part configured to be opened and closed on a side surface of the apparatus body, wherein the discharged-sheet receiving part receives the recording medium along the side surface of the apparatus body, the recording medium is discharged from the image forming part, the discharged-sheet receiving part is also configured to function as a manual paper feed part that supplies a recording medium to the image forming part, and the discharged-sheet receiving part is housed in the apparatus body and has a same surface as the side surface if the discharged-sheet receiving part is closed on the side surface.

2. The apparatus of claim 1, wherein the discharged-sheet receiving part receives the recording medium if the discharged-sheet receiving part is closed, and the discharged-sheet receiving part supplies a recording medium if the discharged-sheet receiving part is opened.

3. The apparatus of claim 1, further comprising, a switch-back roller configured to reverse the recording medium having the image, the switch-back roller positioned on an upper side of the image forming part; and a discharge path configured to guide the recording medium from the switch-back roller toward the discharged-sheet receiving part.

4. The apparatus of claim 1, further comprising a main paper discharge part configured to receive the recording medium which is discharged from the image forming part and is discharged in horizontal direction.

5. The apparatus of claim 4, further comprising a gate configured to move to change a conveyance direction of the recording medium discharged from the image forming part toward the discharged-sheet receiving part or toward the main paper discharge part.

6. The apparatus of claim 5, wherein the gate is further configured to move to define a conveyance direction of the recording medium from the switch-back roller toward the discharge path.

7. The apparatus of claim 1, further comprising a side take-out port configured to allow a user to take out the recording medium from the side surface.

8. The apparatus of claim 1, wherein the discharged-sheet receiving part includes a transparent part.

9. The apparatus of claim 1, wherein the discharged-sheet receiving part is parallel to a conveyance path of the recording medium through the image forming part in the apparatus body when the discharged-sheet receiving part is closed on the side surface.

* * * * *